US005249717A

United States Patent [19]

Inubushi et al.

[11] Patent Number: 5,249,717

[45] Date of Patent: Oct. 5, 1993

[54] ROTARY NOZZLE

[75] Inventors: Hisao Inubushi, Kanagawa; Motoo Amano; Masashi Matsuura, both of Tokyo, all of Japan

[73] Assignee: Nippon Rotary Nozzle Co., Ltd., Kanagawa, Japan

[21] Appl. No.: 894,071

[22] Filed: Jun. 5, 1992

[30] Foreign Application Priority Data

Jun. 11, 1991 [JP] Japan ..... 3-139243

[51] Int. Cl.[5] ..... B22D 41/26

[52] U.S. Cl. ..... 222/598; 222/597

[58] Field of Search ..... 222/597, 598, 599, 600

[56] References Cited

U.S. PATENT DOCUMENTS 3,710,992 1/1973 Hoffmann ..... 222/554
4,591,080 5/1986 Yoshiharal ..... 222/598
5,027,987 7/1991 Beckers ..... 222/598

FOREIGN PATENT DOCUMENTS 3900961 1/1990 Fed. Rep. of Germany .
3843865 2/1990 Fed. Rep. of Germany .
047-5905 3/1972 Japan .
2-263562 10/1990 Japan .
2153977 8/1985 United Kingdom ..... 222/599

*Primary Examiner*—Scott Kastler
*Attorney, Agent, or Firm*—Ladas & Parry

[57] ABSTRACT

A rotary nozzle which is simple in construction and easy to manufacture its bricks, has no danger of leakage of molten steel and is capable of rotatably connecting a collector nozzle and a long nozzle. The rotary nozzle includes a fixed plate brick attached to a base member and having at least a sliding surface thereof formed to incline with an angle of $\theta°$, a slide plate surface having at least a sliding surface thereof formed as an inclined surface corresponding to the sliding surface of the fixed plate brick and fixedly mounted, along with a collector nozzle, in a supporting member, and a frame vertically displaceably supporting the supporting member through a plurality of spring means and bolts and adapted to be driven by driving means mounted on the base member. The lower end of the collector nozzle is formed into a spherical shape so as to ensure its smooth connection with a long nozzle and its rotation.

9 Claims, 6 Drawing Sheets

ROTARY NOZZLE

BACKGROUND OF THE INVENTION

1. Field of the Invention

The present invention relates to a rotary nozzle which is attached to the bottom shell of a molten steel vessel such as a ladle or tundish whereby a slide plate brick is rotated so as to adjust the degree of opening of nozzle bores depending on the relation between the slide plate brick and the fixed plate brick to control the rate of pouring of molten steel.

2. Description of the Prior Art

Rotary nozzles have been used widely with ladles for receiving the molten steel tapped from a converter to transport or pour the molten steel into molds, tundishes for receiving the molten steel from a ladle to pour the molten steel into molds and the like. In particular, the rotary nozzles of the hinged type in which a rotor including a slide plate brick is opened and closed by rotating it by a hinge have recently been used in great number due to its various advantages that the sliding surfaces can be exposed so as to confirm for example the damages to the plate surfaces of the fixed plate brick and the slide plate brick with the naked eye, that there is no need to prepare any stand-by set in case of the changing or the maintenance and repair of the bricks, that the operation is easy and so on.

Such rotary nozzle of the hinged type is pivotably fitted to the base member attached directly or through a member to the bottom shell of a ladle, tundish or the like (hereinafter referred to as a molten steel vessel) and the reduction gear output from a driving source, e.g., a motor is transmitted through an intermediate gear to the gear of the rotor including the slide plate brick, mounted in a door, thus rotating the rotor and hence the slide plate brick and thereby adjusting the opening of the nozzle.

FIG. 6 is a sectional view of an example of the conventional rotary nozzle. In the Figure, numeral 51 designates the bottom shell of a molten steel vessel, and 52 a base member attached to the bottom shell 51 with bolts 53 and a fixed plate brick 54 is mounted in the base member 52. Numeral 56 designates a top nozzle projected through a bore formed through the bottom shell 51 of the molten steel vessel and the base member 52 and connected to a nozzle bore 55 of the fixed plate brick 54. Numeral 57 designates a fixed frame pivotably attached to the base member 52 by a hinge 58. Numeral 59 designates a rotor received in the fixed frame 57, arranged rotatably on a bearing guide 62 through a ball bearing 60, formed on the outer periphery thereof with a gear 61 meshed with a gear (not shown) connected to the driving source and receiving a slide plate brick 63 in the upper part thereof. Numeral 65 designates a collector nozzle connected to a nozzle bore 64 of the slide plate brick 63, and 66 a nozzle bore in the collector nozzle. Numeral 67 designates a plurality of spring seats which are provided within the fixed frame 57 to face the bearing guide 62 with a coil spring 68 being mounted between each of the spring seats and the bearing guide 62. Thus, a door 70 is formed by the fixed frame 57, the rotor 59, etc.

With the rotary nozzle constructed as described above, during the pouring of molten steel the door 70 is closed and fastened to the base member 52 so that the slide plate brick 63 is pressed against the fixed plate brick 54 by the coil springs 68 and there is no danger of the leakage of the molten steel. It is to be noted that if necessary, the rotor 59 is rotated from the driving source and the degree of opening of the nozzle bores 55 and 64 is adjusted, thereby controlling the pouring rate of the molten steel. Also, in order to effect the maintenance and inspection of the change of the fixed plate brick 54 and the slide plate brick 63, the door 70 can be pivoted on the hinge 58 to open the door 70.

The rotary nozzle of the above type has been widely put in practical use as a device for controlling the pouring rate of molten steel by virtue of the fact that it is small in size, light in weight and positive in operation. However, this type of rotary nozzle is disadvantageous in that while the center lines of the nozzle bores 55 and 64 of the fixed plate brick 54 and the slide plate brick 63 are in alignment as shown in FIG. 6 when these nozzle bores are fully open, when the slide plate brick 63 is rotated to reduce the degree of opening of the nozzle bores 55 and 64, there is caused a deviation between the center line of the nozzle bore 55 of the fixed plate brick 54 and the center line of the nozzle bores 64 and 66 of the slide plate brick 63 and the collector nozzle 65 as shown in FIG. 7 with the result that the molten steel emerging from the nozzle bore 55 of the fixed plate brick 54 changes its direction to fall towards the inner wall of the nozzle bore 66 of the collector nozzle 65 and thereby damaging the inner wall of the nozzle bore 66 of the collector nozzle 65 and also the solidified steel is accumulated on the inner wall thereby extremely reducing the life of the expensive collector nozzle 65.

Further, with the latest rotary nozzles of the type used for the continuous casting of steel, while it is essential to provide a long nozzle 71 below the collector nozzle 65 as shown in FIG. 7, the long nozzle 71 is fixed in place in a manner that its nozzle bore 72 is positioned in alignment with the nozzle bore 55 of the fixed plate brick 54 with the result that when the nozzle bores 55 and 64 are reduced in the degree of opening, there is the danger of the nozzle bore 66 of the collector nozzle 65 shifting from the nozzle bore 72 of the long nozzle 71 and thereby failing to pour the molten steel. As a result, the supporting member of the long nozzle 71 is provided with a joint to make a so-called oscillatory motion and this has not only the undesirable effect of making the construction extremely complicated and expensive but also the effect of making difficult the sealing between the molten steel vessel and the long nozzle 71 due to the movement of the long nozzle 71. In addition, where the long nozzle 71 is inserted into a center runner such as a bottom pouring runner to pour the molten steel, there are many difficulties that the movement of the long nozzle 71 causes it to strike against the center runner and so on.

The invention disclosed in Japanese Laid-Open Patent No. 47-05905 is an example of the proposals heretofore made to overcome the foregoing problems of the conventional rotary nozzle. This invention is constructed so that the axis of rotation of an elongated frusto-conical slide member is arranged to make an acute angle (7 degrees according to an embodiment) with the central axis of a flow passage through the slide member and the outlet opening of the slide member flow passage is maintained at the same position in response to all the positions of the slide member, with the result that the outflowing molten material passes freely and vertically through the flow passage at the position of the slide member which completely opens the flow passage and the position of the nozzle bore in the lower part of the collector nozzle is not allowed to deviate at the throttled slide member positions.

Also, the invention disclosed in Japanese Laid-Open Patent No. 2-263562 consists in a rotary nozzle which is intended to attain the same purpose as mentioned above and in which a discharge block contacting an annular supporting casing has an outer peripheral surface whose contacting portion is formed of a spherical shape, thereby making uniform the pressure at the close contacting sliding surfaces of an upper block and the discharge block.

In accordance with the invention disclosed in Japanese Laid-Open Patent No. 47-5905, a perforated plate is supported below a casing so that the static pressure of molten steel is directly applied to the perforated plate and an excessive interfacial pressure is produced at the contact surface between the perforated plate and the lower part of the casing, thereby giving rise to the danger of damaging the perforated plate.

Further, in accordance with Japanese Laid-Open Patent No. 47-5905 and Japanese Laid-Open Patent No. 2-263562, respectively, a slide plate brick and a colletor nozzle are combined as a unit to form a slide member or a discharge block thus making the manufacture difficult. Particularly, in the case of the latter invention, the rotary nozzle is constructed so that the discharge block contacting with the annular supporting casing has an outer peripheral surface formed of a spherical shape to follow up an inclination error and therefore not only is the construction complicated and the working is difficult but also the follow-up fails to take place if the sliding of the spherical surface is not good thereby deteriorating the reliability. Also, since the slide member or the discharge block is pressed against the performed plate or the upper block by simply fastening the casing in place with bolts directly or through spring packs, the two are not uniform in contract pressure and the molten steel tends to leak; particularly, the two cannot be contacted closely if the precision of the inclined surface is not satisfactory.

Further, since the lower end portion of the slide member or the discharge block is in the form of an inclined surface, the connection with the fixedly arranged long nozzle is extremely troublesome.

Still further, the former is so designed that the supporting ring supporting the slide member is provided with external teeth and the rack engaging with the external teeth is driven by the operating cylinder thereby rotating the slide member, the driving mechanism and hence the whole apparatus is extremely increased in size. On the other hand, the rotary nozzle of the latter invention has many disadvantages that the supporting , 987ng supporting the discharge block is provided with a worm gear so as to rotate it by a worm so that during the rotation of the worm gear the sliding surfaces of the discharge block and the upper block are separated thus giving rise to the danger of frequently causing troubles of molten steel leakage and so on and therefor its realization is difficult.

SUMMARY OF THE INVENTION

The present invention has been made with a view to overcoming the foregoing deficiencies in the prior art, and it is the primary object of the present invention to provide a rotary nozzle which is simple in construction, is easy to manufacture its bricks, has no danger of molten steel leakage due to the uniform and close contact between its slide plate brick and fixed plate brick, and is capable of positively connecting its collector nozzle and long nozzle with each other.

To accomplish the above object, in accordance with the present invention there is thus provided a rotary nozzle including a base member attached to the bottom shell of a molten steel vessel, driving means rotatably mounted on the base member, a fixed plate brick including a nozzle bore, having at least its sliding surface inclined at an angle of $\theta°$ and attached to the base member, a slide plate brick including a nozzle bore, having at least its sliding surface formed into an inclined surface which matches with the sliding surface of the fixed plate brick and attached, along with a collector nozzle to supporting means, a frame arranged below the supporting means, pivotably attached like a door to the driving means and connected to the supporting means so as to permit a vertical displacement of the supporting means, and a plurality of spring means interposed between the frame and the supporting means.

Then, in the rotary nozzle, the angle of inclination $\theta°$ of the sliding surface of the fixed plate brick is selected between 5° and 15° relative to the horizontal surface or the lower end portion of the collector nozzle is formed into a spherical shape.

When the nozzle bores of the fixed plate brick and the side plate brick are fully open, the nozzle bores of the top nozzle, the fixed plate brick, the slide plate brick and the collector nozzle are aligned with one another so that the molten steel falls vertically and it is poured by way of the long nozzle.

When the frame is rotated by the driving means, the rotation is transmitted to the slide plate brick and the collector nozzle through the supporting member so that the degree of opening between it and the nozzle bore of the fixed plate brick is adjusted and the rate of pouring is controlled. At this time, the perpendicular passing through the center of the nozzle bore of the fixed plate brick and the line passing through the centers of the nozzle bores of the slide plate brick and the collector nozzle cross each other at the lower end of the collector nozzle and thus the slide plate brick and the collector nozzle are always rotated about this point of intersection.

As a result, the opening of the nozzle bore in the collector nozzle is always opened to the nozzle bore of the fixed long nozzle and therefore the molten steel can be positively poured into the nozzle bore of the long nozzle. In this case, by forming the lower end portion of the collector nozzle into a spherical shape, it is possible to smoothly rotate the collector nozzle while maintaining the sealing quality at the joint.

The above features and advantages of the present invention will become readily apparent from the following detailed description of its embodiments taken in conjunction with the accompanying drawings.

DESCRIPTION OF THE PREFERRED EMBODIMENTS

Figure 1:
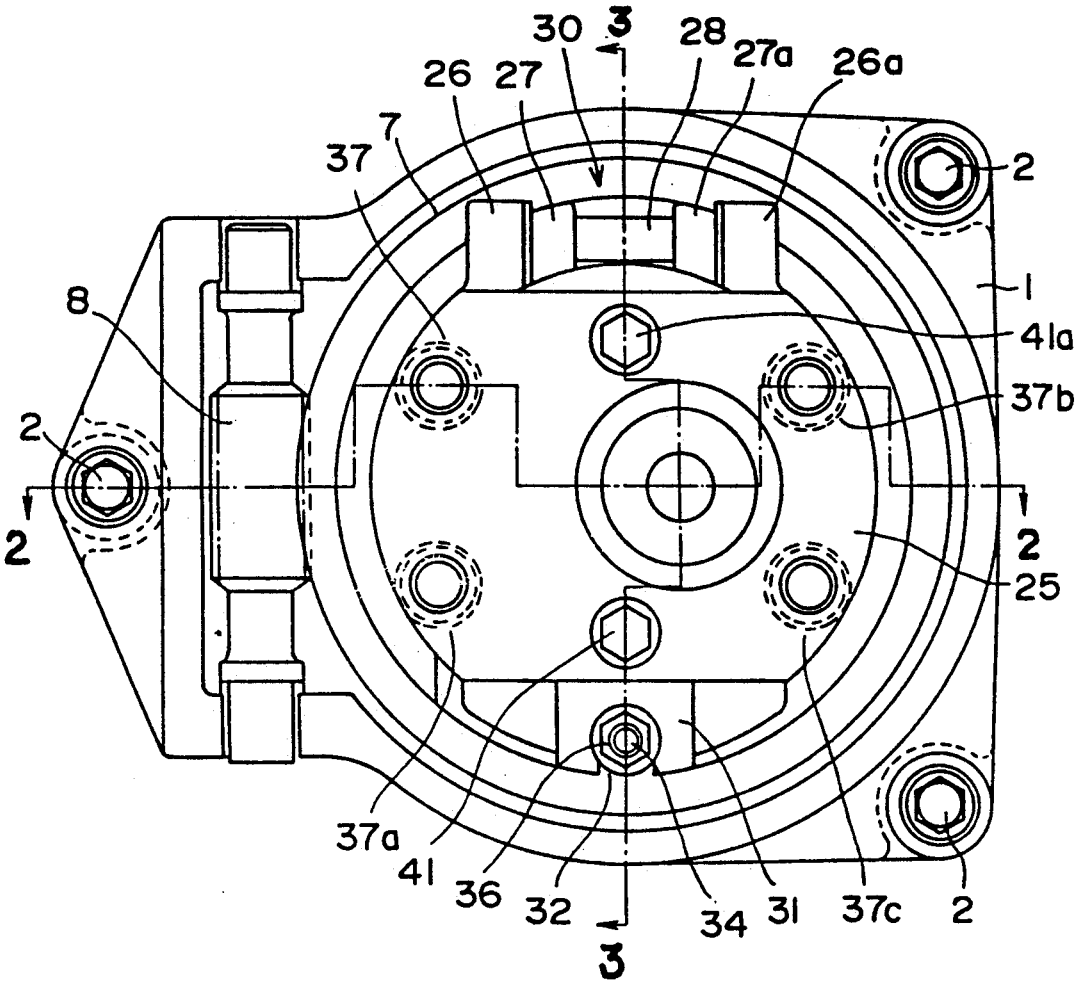
FIG. 1 is a bottom view of an embodiment of the present invention.
Figure 2:
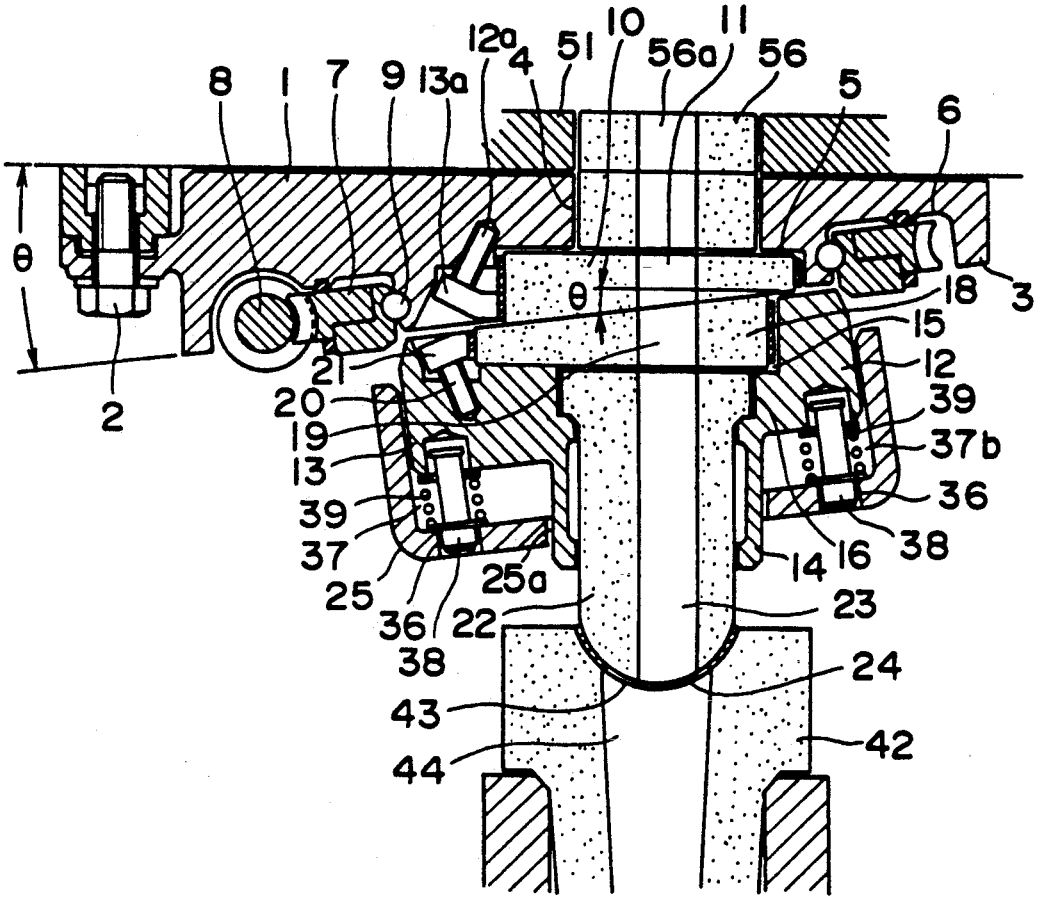
FIG. 2 is a sectional view taken along the line A—A in FIG. 1.
Figure 3:
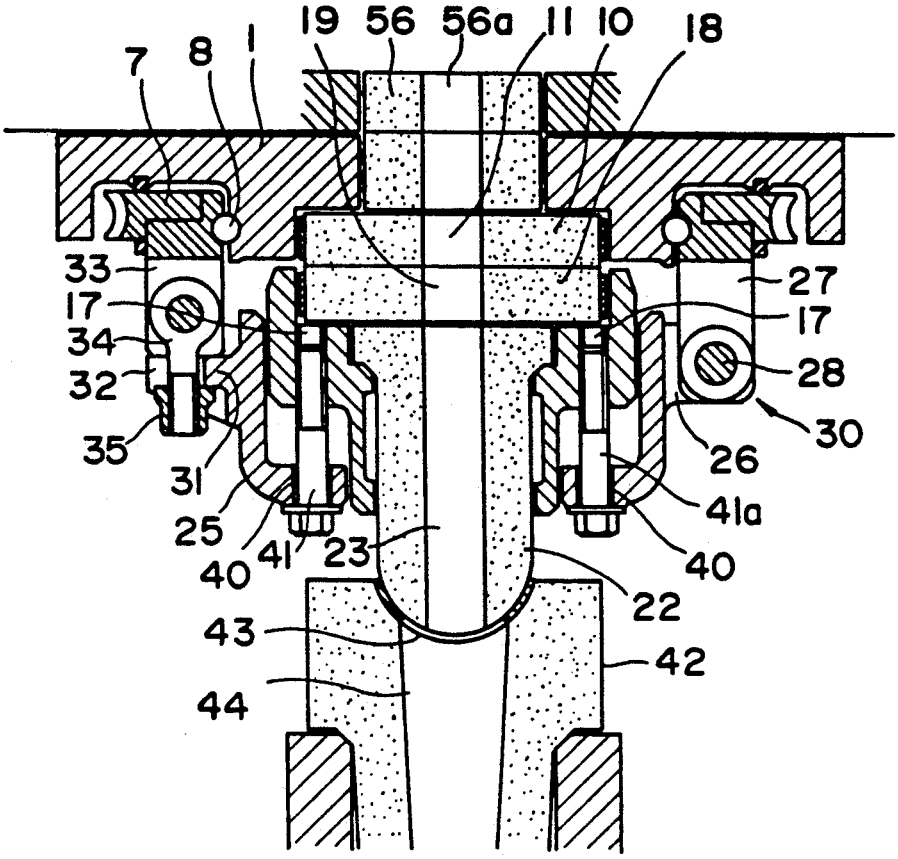
FIG. 3 is a sectional view taken along the line B—B in FIG. 1.

FIG. 1 is a bottom view of an embodiment of the present invention, and FIGS. 2 and 3 are sectional views respectively taken along the lines A—A and B—B of FIG. 1. In the Figures, numeral 1 designates a base member attached by bolts 2 to a bottom shell 51 of a molten steel vessel directly or through other member and having its lower surface formed as an inclined surface 3 at an angle of $\theta°$ with respect to the horizontal. In this embodiment, the angle $\theta°$ is 7.5°. Numeral 4 designates a through-hole in which is fitted a top nozzle 56 having a nozzle bore 56*a*, and 5 a recess formed below the hole 4 and having a bottom with a horizontal surface. Numeral 7 designates a worm gear rotatably arranged through a ball bearing 9 within an annular groove 6 formed on the outer periphery of the recess 5 of the base member 1, and 8 a worm which engages with the worm gear 7.

Numeral 10 designates a fixed plate brick having an upper surface formed as a horizontal surface and a lower sliding surface formed as an inclined surface of the same angle $\theta°$ as the angle of inclination of the inclined surface 3 of the base member 1. With its upper surface on top, the fixed plate brick 10 is arranged within the recess 5 of the base member 1 and fastened to the base member 1 with bolts 12*a* through a fixing member 13*a*. Numeral 11 designated a nozzle bore extending to perpendicularly to the horizontal surface of the fixed plate brick 10 and communicating with the nozzle bore 56*a* of the top nozzle 56.

Numeral 12 designates a supporting member composed of a body portion 13 inclined at an angle $\theta°$ relative to the horizontal and a leg portion 14 vertically dependent from the body portion 13. A recess 15 having a horizontal bottom is formed in the upper surface of the supporting member 12 and a bore 16 is formed through the leg portion 14 to be eccentric with the center of the recess 15.

Numeral 18 designates a slide plate brick having the same external shape as the fixed plate brick 10 (however, the position of a nozzle bore 19 is different), arranged in the recess 15 of the supporting member 12 with the horizontal surface inverted and fixed in place by bolts 20 through a supporting member 21. Numeral 19 designates the nozzle bore formed to perpendicularly cross the horizontal surface of the slide plate brick 18. Numeral 22 designates a collector nozzle inserted and supported within the hole 16 of the supporting member 12, having its upper surface connected to the lower surface of the slide plate brick 18 and including a lower end portion formed of a spherical shape. Numeral 23 designates a nozzle bore formed through the collector nozzle 22 so as to perpendicularly cross the horizontal surface and to be eccentric with the central position.

Numeral 25 designates a frame of a cylinder with closed bottom arranged below the supporting member 12 so as to enclose it and formed in its bottom with a hole 25*a* into which is inserted the leg portion 14 of the supporting member 12. Arms 26 and 26*a* are arranged on one side of the longitudinal direction of the worm 8 of the frame 25 to project therefrom and are respectively connected by a pin 28 to support arms 27 and 27*a* which are dependent from the worm, gear 7, thereby forming a hinge 30. Also, arranged on the other side is an arm 31 having a U-shaped engaging slot 32 and projecting therefrom, and fitted in the engaging slot 32 is a swing bolt 34 which is pivotably mounted on a support arm 33 depending from the worm gear 7 and fixed in place by a nut 35.

Numerals 37 to 37*c* designate spring means which are interposed between the frame 25 and the supporting member 12 and which are each composed of a guide shaft 38 having its lower end loose-fitted in a hole 36 formed in the bottom of the frame 25 and its upper end loose fittled in the hole formed in the supporting member 12 and a coil spring 39 mounted on the guide shaft 38 through its spring seats. It is to be noted that while the spring means 37 to 37*c* are arranged at four locations in the illustrated embodiment, the spring means may be provided at three locations or five or more locations and also the coil springs 39 may be replaced with crown springs.

Numerals 41 and 41*a* respectively designate clamping bolts which are each slidably inserted into a hole 40 formed through the bottom of the frame 25 and threadedly fitted into a threaded hole 17 formed in the supporting member 12. These clamping bolts have the purpose of not only fastening together the supporting member 12 and the frame 25 as a unit but also adjusting the spring pressure of the spring means 37 to 37*c*, and the supporting member 12, which is adapted for rotation in cooperation with the frame 25, is permitted to independently displace vertically. Numeral 42 designates a long nozzle formed in the upper surface thereof with a recess 43 having a spherical shape corresponding to the shape of the lower end 24 of the collector nozzle 22 and provided w3ith a nozzle bore 44 of a greater diameter than the nozzle bore 23 of the collector nozzle 22 which in turn is rotatably connected to the long nozzle 42.

With the construction described above, the operation of the rotary nozzle according to the present invention will now be described. When the nozzle bores 11 and 19 of the fixed plate brick 10 and the slide plate brick 18 are fully open, the nozzle bores 56*a*11, 19 and 23 of the top nozzle 56, the fixed plate brick 11, the slide plate brick 18 and the collector nozzle 22 are on the same vertical line and also the nozzle bore 44 of the long nozzle 42 is practically on the same vertical line as the nozzle bore 23 of the collector nozzle 22. Thus, the molten steel within the molten steel vessel is poured by falling substantially vertically through the nozzle bores of the respective nozzles from the nozzle bore 56*a* of the top nozzle 56.

Figure 4:
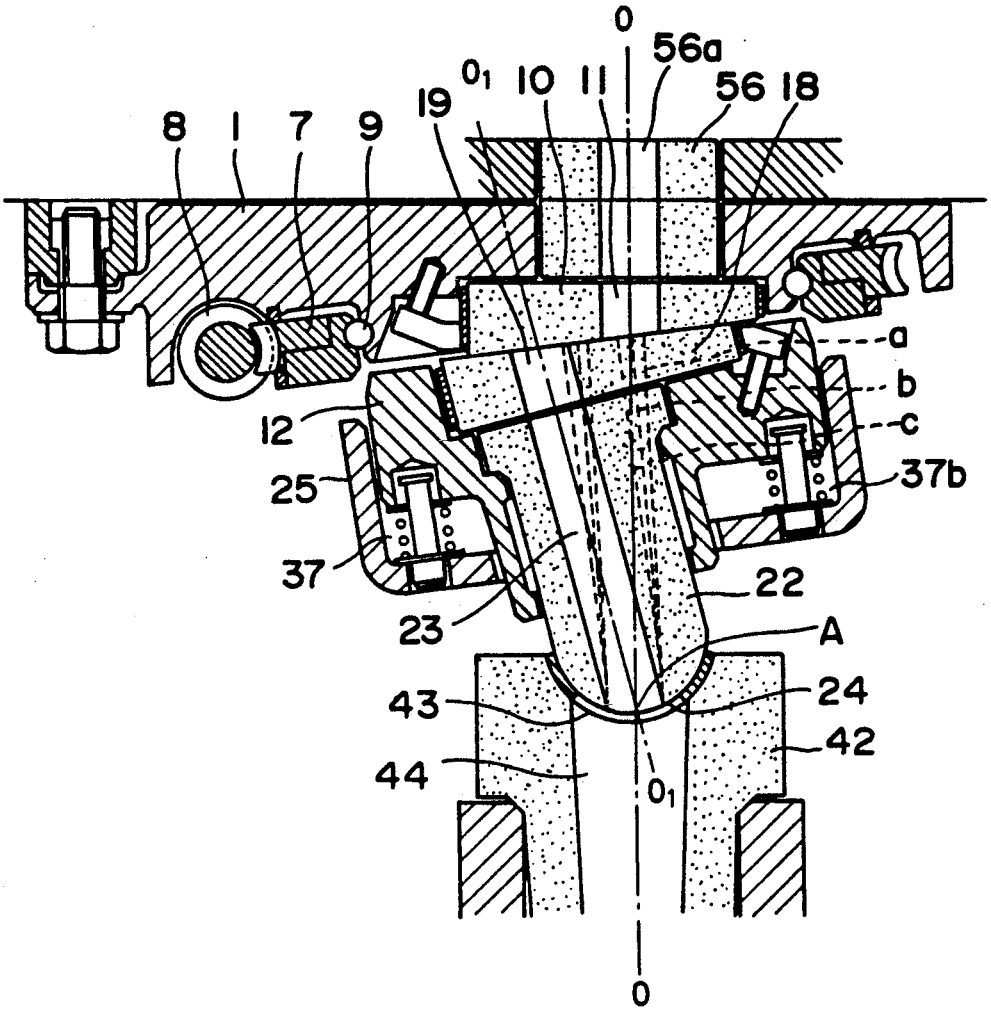
FIG. 4 is a view useful for explaining the operation of the embodiment of the present invention.

When the nozzle bores 11 and 19 of the fixed plate brick 10 and the slide plate brick 18 are to be fully closed, the worm 8 is driven from the driving source (not shown) and the worm gear 7 is rotated. The rotation of the worm gear 7 is transmitted to the frame 25 through the support arms 27, 27*a* and 33 and the rotation of the frame 25 is in turn transmitted to the supporting member 12 by the corner portions of the supporting member 12 and the frame 25. Then, the slide plate brick 18 secured to the supporting member 12 is rotated along the inclined sliding surface of the fixed plate brick 10. At this time, the lower end of the collector nozzle 22 is rotated along the recess 43 of the long nozzle 42 to follow the rotation and inclination of the slide plate brick 18. FIG. 4 shows the condition in which the nozzle bore 19 of the slide plate brick 18 has been rotated through 180° from the fully-opened position.

As will be seen from FIG. 4, even if the slide plate brick 18 has been rotated through 180 degrees, the center line O—O of the nozzle bores 56*a* and 11 of the top nozzle 56 and the fixed plate brick 10 and the center line $O_1$—$O_1$ of the nozzle bores 19 and 23 of the slide plate brick 18 and the collector nozzle 22 cross each other at the lower end of the collector nozzle 22. In other words, since the slide plate brick 18 and the collector nozzle 22 are rotated about the intersection point A, irrespective of the position of the nozzle bore 19 of the slide plate brick 18, the point A and hence the opening of the nozzle bore 23 of the collector nozzle 22 is always at the same position and thus it is opened onto the nozzle bore 44 of the long nozzle 42.

As a result, as shown by the broken lines a, b and c in FIG. 4, even if the slide plate brick 18 is rotated, the opening of the nozzle bore 23 of the collector nozzle 22 is always opened onto the nozzle bore 44 of the long nozzle 42 so that there is no need to cause the long nozzle 42 to make an oscillatory motion as in the past and it can be fixed in that position.

In order to effect maintenance and inspection or change of the sliding surfaces of the fixed plate brick 10 and the slide plate brick 18, after the long nozzle 42 has been removed, the clamping bolts 40 and 41 are tightened and the supporting member 12 is moved downward to restrain the spring forces. Then, the nut 35 of the swing bolt 34 is loosened and turned to disengage the swing bolt 34 from the engaging slot 32 and the frame 25 is pivoted about the hinge 30. When this occurs, the unit composed of the frame 25, the supporting member 12, the slide plate brick 18 and the collector nozzle 22 is opened like a door and the sliding surfaces of the fixed plate brick 10 and the slide plate brick 18 are exposed, thereby making it possible to easily inspect or change these components.

When the maintenance and inspection or the change has been completed, the frame 25 is pivoted on the hinge 30 thus closing the rotary unit. Then, the swing bolt 34 is engaged with the engaging slot 32 and the nut 35 is tightened. Thereafter, the clamping bolts 40 and 41 are loosened so as to apply an interfacial pressure to the sliding surfaces of the fixed plate brick 10 and the slide plate brick 18. At this time, the supporting member 12 and the slide plate brick 18 are uniformly urged upward by the spring means 37 to 37*c* provided at the plurality of locations and therefore the slide plate brick 18 can be pressed closely against the sliding surface of the fixed plate brick 10 with a uniform pressure.

Figure 5:
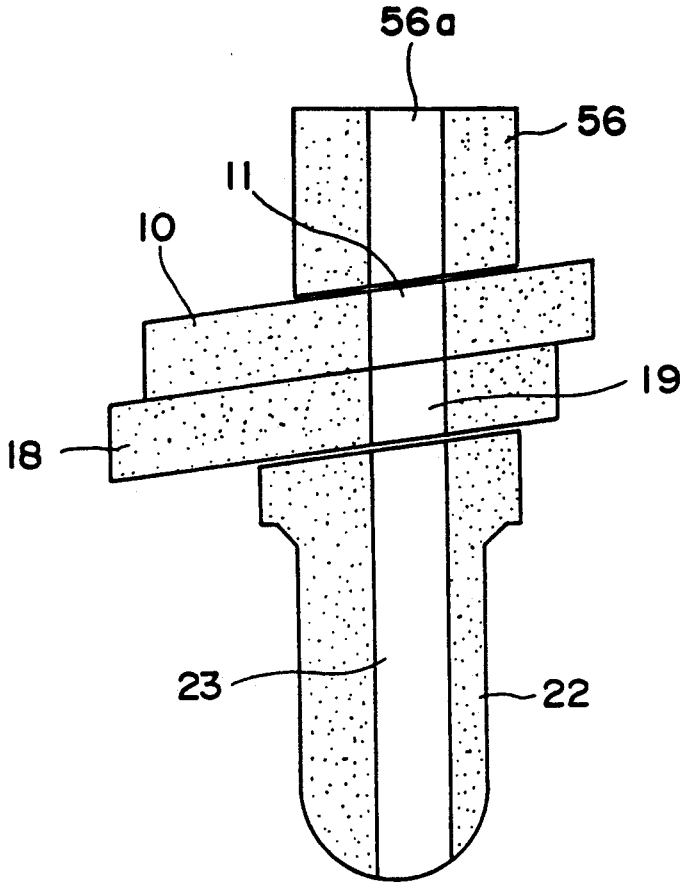
FIG. 5 is a schematic view showing the principle parts of another embodiment of the present invention.
Figure 6:
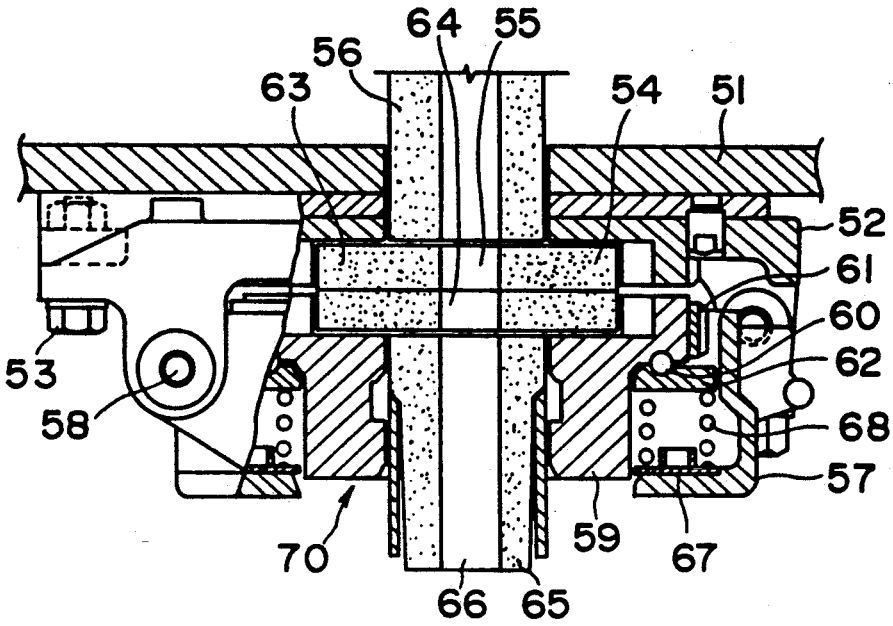
FIG. 6 is a sectional view showing a conventional rotary nozzle by way of example.
Figure 7:
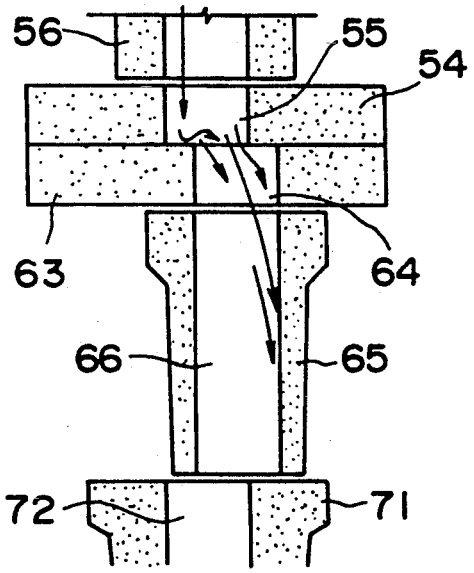
FIG. 7 is a sectional view useful for explaining the operation of the rotary nozzle of FIG. 6.

FIG. 5 is a schematic diagram showing the principal parts of another embodiment of the present invention. While, the embodiment of FIGS. 1 to 3 shows the case in which the sliding plate surfaces of the fixed plate brick 10 and the slide plate brick 18 are inclined and the other surfaces are in the form of horizontal surfaces, as shown in FIG. 5, the sliding surfaces of the fixed plate brick 10 and the slide plate plate brick 18 may be inclined and the other surfaces may also be inclined in parallel to the sliding surfaces. In this case, however, it is necessary that the lower surface of the top nozzle 56 and the upper surface of the collector nozzle 22 are inclined in correspondence with these inclined surfaces.

Even if the fixed plate brick 10 and the slide plate brick 18 are constructed in this way, the same effect as the embodiment of FIG. 1 to 3 can be obtained.

While, in the above description the lower surface of the base member 1 and the upper surface of the supporting member 12 are inclined in correspondence with the angle of inclination of the sliding surfaces of the fixed plate brick 10 and the slide plate brick 18, the lower surface of the base member 1 and the upper surface of the supporting member 12 may be horizontal. Also, while the worm gear 7 and the worm 8 are used to rotate the frame 25 and hence the slide plate brick 18, any other driving means such as a helical gear or a spur gear may be used.

Further, while the lower end of the collector nozzle 22 is formed into a spherical shape so as to simplify its connection with the long nozzle 42 and rotate it smoothly, the lower end of the collector nozzle 22 may be formed with a flat shape in cases where it is not connected with the long nozzle 42. It is to be noted that while, in the above-described embodiments, the inclination angle $\theta°$ for the sliding surfaces of the fixed plate brick 10 and the slide plate brick 18 is set to 7.5° with respect to the horizontal surface, the results of experiments have confirmed that the proper range for the angle $\theta$ is between 5°, and 15°.

As will be seen from the foregoing description, by virtue of the fact that at least the sliding surfaces of the fixed plate brick and the slide plate brick are inclined and the slide plate brick and the collector nozzle are rotated about the lower end of the collector nozzle, the rotary nozzle according to the present invention has the following effects.

(1) The manufacture of the rotary nozzle is made easy due to the fact that the slide plate brick and the collector nozzle are constructed as separate members and that the slide plate brick and the collector nozzle can be respectively produced with a material of good quality and a material which is slightly lower in grade than the former with a resulting reduction in cost.

(2) Since the fixed plate brick and the slide plate brick are the same in external shape, they can be produced by use of the same mold with a resulting reduction in cost.

(3) Since the slide plate brick is pressed against the fixed plate brick by the spring means, the close contact between the sliding surfaces of the two bricks can be maintained even if the inclination accuracy of the sliding surfaces is deteriorated (this may be caused in the course of manufacture and assembly).

(4) Due to the construction in which the driving means is attached to the base member and a thrust force produced during the forward or reverse rotation of the driving means is resisted by the base member through the ball bearing, there is no effect on the slide plate brick.

(5) Since the lower end of the collector nozzle is formed with a spherical shape, it can be easily connected with the long nozzle and also the collector nozzle is permitted to rotate smoothly.

We claim:

1. A rotary nozzle assembly for controlling rate of pour of molten metal through a discharge outlet in a bottom wall of a vessel, said rotary nozzle assembly comprising:

a base plate fixedly attachable to the bottom wall of a vessel containing molten metal, said base plate having an opening aligned with the discharge outlet in the bottom wall of the vessel, a fixed plate brick secured to said base plate and having a sliding surface inclined at an angle of 7.5° with respect to the horizontal, said fixed plate brick having a base communicating with said opening in said base plate, a sliding plate brick having a sliding surface in sliding contact with the sliding surface of the fixed plate brick, said sliding surface of said sliding plate brick having the same angle of inclination as the sliding surface of the fixed plate brick, said sliding plate brick having a bore therethrough, a collector nozzle fixed relative to said sliding plate brick and having a nozzle bore aligned with said bore in the sliding plate brick, said collector nozzle including an end portion of spherical shape supported for rocking movement, a frame arranged below said support means, support means supporting said sliding plate brick and said collector nozzle for common movement, drive means on said base plate for driving said frame in rotation, means supporting said support means from said frame for common rotation therewith and for vertical displacement relative thereto, a plurality of spring means between said frame and said support means to urge the sliding surface of the sliding plate brick against the sliding surface of the fixed plate brick, means pivotably connecting said frame relative to said base plate for movement between an operative position in which said sliding surface of the sliding plate brick is in sliding contact with the sliding surface of the fixed plate brick and an inoperative dropped position in which said sliding surfaces are exposed.

2. A rotary nozzle assembly as claimed in claim 1, wherein said end portion of spherical shape on said collector nozzle is located at a lower end of said collector nozzle and is supported in a spherical support of a long nozzle to undergo said rocking movement about a support point on said end portion of spherical shape located on an axis of said nozzle bore in said collector nozzle, said frame being driven in rotation by said drive means around an axis perpendicular to said sliding surfaces.

3. A rotary nozzle assembly as claimed in claim 2, wherein said long nozzle has a bore communicating with the bore in said collector nozzle, said bore in said long nozzle having an axis which intersects the axis of said nozzle bore in said collector nozzle at said support point around which said collector nozzle undergoes rocking movement.

4. A rotary nozzle assembly as claimed in claim 1, wherein said means supporting said support means from said frame comprises a pair of bolts slidably engaged in said frame and threadably engaged in said support means.

5. A rotary nozzle assembly as claimed in claim 4, wherein said plurality of spring means each comprises a guide pin slidably supported in said frame and said support means and a spring surrounding said pin and bearing against said support means and said frame.

6. A rotary nozzle assembly for controlling rate of pour of molten metal through a discharge outlet in a bottom wall of a vessel, said rotary nozzle assembly comprising:

a base plate fixedly attachable to the bottom wall of a vessel containing molten metal, said base plate having an opening communicating with the discharge outlet in the bottom wall of the vessel, an upper nozzle member in said opening in said base plate end including a top portion extending through the discharge opening in the bottom wall of said vessel, said nozzle member have a lower end surface inclined at an angle of 5° to 15° relative to the horizontal, said upper nozzle having a vertical bore extending therethrough, a fixed plate brick fixed to said base plate and having a bore communicating with the bore in said upper nozzle member, said fixed plate brick having an upper surface inclined in correspondence with sid lower end surface of said nozzle member and engaged thereagainst, said fixed plate brick having a lower sliding surface extending parallel to said upper surface, a sliding plate brick having a bore therethrough, said sliding plate brick having an upper sliding surface inclined in correspondence with said lower sliding surface of said fixed plate brick and engaged thereagainst and a lower surface parallel to said upper surface, a collector nozzle fixed relative to said sliding plate brick and having a bore communicating with the bore in said sliding plate brick, said collector nozzle having an upper surface inclined in correspondence with said lower surface of said sliding plate brick, said bores in said upper nozzle member, said fixed plate brick, said sliding plate brick and said collector nozzle being substantially aligned in a position of maximum flow of molten metal through the rotary nozzle assembly with said inclined surfaces of said upper nozzle member, said fixed plate brick, said sliding plate brick and said collector nozzle extending parallel to one another, said collector nozzle having a lower end of spherical shape supported for rocking movement, support means connecting the collector nozzle to said sliding plate brick, drive means on said base plate, a frame arranged beneath said support means, said frame being coupled to said drive means for being rotated to adjust magnitude of communication between said bores and thereby flow of molten metal through the nozzle assembly, a pivot connection between said frame and said base plate to enable said frame to pivot from an operative position in which the sliding surfaces of said fixed plate brick and said sliding plate brick are in slidable contact to an inoperative dropped position in which said sliding surfaces are exposed, said support means being supported from said frame for relative vertical displacement, and a plurality of spring means between said frame and said support means to urge the sliding surface of the sliding plate brick against the sliding surface of the fixed plate brick.

7. In a rotary nozzle assembly controlling rate of pour of molten metal through a discharge outlet in a bottom wall of a vessel, the nozzle assembly having a fixed base plate in which a fixed plate brick is supported and molten metal passes through the fixed base plate and the fixed plate brick in a flow amount controlled by movement of a sliding plate brick urged against the fixed plate brick, the improvement comprising:

a brick block having a central bore, said brick block being disposed in the base plate with said central bore communicating with the molten metal in said vessel, said brick block having one surface extending perpendicularly to said central bore and an opposite surface for contacting the fixed plate brick which is inclined at an angle of 5° to 15° relative to an axis of said central bore.

8. The improvement as claimed in claim 7, wherein said brick block includes a portion extending within the discharge outlet of the vessel.

9. The improvement as claimed in claim 8, wherein said brick block has a substantially cylindrical outer surface.

* * * * *

UNITED STATES PATENT AND TRADEMARK OFFICE

CERTIFICATE OF CORRECTION

PATENT NO. : 5,249,717

DATED : OCTOBER 5, 1993

INVENTOR(S) : Hisao INUBUSHI, et al.

It is certified that error appears in the above-identified patent and that said Letters Patent is hereby corrected as shown below:

Title page, Item [73] Assignee, add the three additional Assignees:

-- NKK CORPORATION, TOKYO, JAPAN;
KOKAN KIKAI KOGYO KABUSHIKI KAISHA, KANAGAWA-KEN, JAPAN;
TOKYO YOGYO KABUSHIKI KAISHA, TOKYO, JAPAN --

Signed and Sealed this
Twelfth Day of April, 1994

*Attest:*

*Attesting Officer*

Bruce Lehman

BRUCE LEHMAN

*Commissioner of Patents and Trademarks*